US005285026A

United States Patent [19]

Lemetyinen

[11] Patent Number: 5,285,026

[45] Date of Patent: Feb. 8, 1994

[54] REACTIVE SOUND ATTENUATOR, IN PARTICULAR FOR AIR DUCTS IN PAPER MILLS

[75] Inventor: Markku Lemetyinen, Turku, Finland

[73] Assignee: Valmet Paper Machinery Inc., Finland

[21] Appl. No.: 844,839

[22] Filed: Mar. 3, 1992

[30] Foreign Application Priority Data

Mar. 18, 1991 [FI] Finland ..... 911305

[51] Int. Cl.[5] ..... F04F 17/04; F01N 1/10; F01N 1/08

[52] U.S. Cl. ..... 181/224; 181/247; 181/249; 181/252; 181/264; 181/269; 181/272

[58] Field of Search ..... 181/224, 252, 256, 264, 181/272, 281, 247, 249, 269

[56] References Cited

U.S. PATENT DOCUMENTS

| | | | |
|---|---|---|---|
| 2,730,188 | 1/1956 | Bailey | 181/47 |
| 4,192,404 | 3/1980 | Nakagawa et al. | 181/272 |
| 4,305,477 | 12/1981 | Moore | 181/249 |
| 4,589,516 | 5/1986 | Inoue et al. | 181/256 |
| 4,660,676 | 4/1987 | Eustace | 181/224 |

FOREIGN PATENT DOCUMENTS

| | | |
|---|---|---|
| 852479 | 7/1949 | Fed. Rep. of Germany . |
| 891343 | 7/1949 | Fed. Rep. of Germany . |
| 2438794 | 2/1976 | Fed. Rep. of Germany . |
| 3236568 | 4/1984 | Fed. Rep. of Germany . |
| 8907739 | 8/1989 | World Int. Prop. O. . |

OTHER PUBLICATIONS

Leo L. Beranek, Noise and Vibration Control, McGraw-Hill, New York, New York, pp. 366–381.

*Primary Examiner*—Michael L. Gellner
*Assistant Examiner*—Eddie C. Lee
*Attorney, Agent, or Firm*—Steinberg & Raskin

[57] ABSTRACT

The invention concerns a reactive sound attenuator for air-conditioning ducts, in particular for air ducts in paper mills. The sound attenuator includes at least two chambers separated from another by means of a partition wall. The partition wall is provided with an opening or with a tube placed in the direction of flow of the air flowing through the sound attenuator, the air flowing through said opening or tube out of one chamber into the other. The main plane of the partition wall is at an acute angle in relation to the direction of air flow through the sound attenuator. Preferably, the partition wall is at an angle α from about 40° to about 70° in relation to the direction of air flow through the sound attention.

16 Claims, 7 Drawing Sheets

REACTIVE SOUND ATTENUATOR, IN PARTICULAR FOR AIR DUCTS IN PAPER MILLS

BACKGROUND OF THE INVENTION

The present invention concerns a reactive sound attenuator for air-conditioning ducts, in particular, for air ducts in paper mills. The sound attenuator comprises at least two chambers separated from one another by means of a partition wall, which partition wall is provided with an opening or with a tube placed in the direction of flow of the air flowing through the sound attenuator, the air flowing through the opening or tube out of one chamber into the other.

Ever stricter requirements are imposed on suppression of noise in the environment. One important source of noise consists of the intake and exhaust air pipes for ventilation in connection with various industrial plants and other large buildings, through which pipes especially the noise of flowers is spread into the environment. The blowers are usually chosen on the basis of the quantity of air produced by them, and attention is frequently not paid to the noise produced by them. The noise produced by the blowers has quite a wide spectrum, which also imposes particular requirements on the noise suppression.

Regarding noise suppression, paper mills are particularly demanding, because the ventilation of the paper machine hall and in particular the elimination of moisture from the drying section of the paper machine require large quantities of air.

Since the noise produced by blowers has quite a wide spectrum in the intake and exhaust air ducts connected to the blowers, it is frequently necessary to use both absorptive and reactive sound attenuators. Absorptive sound attenuators operate primarily at higher frequencies; and maximum of their attenuation is at a frequency of about 1000 Hz, whereas reactive sound attenuators operate most efficiently at low frequencies, and their maximum attenuation, is, as a rule, tuned in a range of about 100–200 Hz.

For sound attenuation at low frequencies, there are various principles, whose application have been used and are used in sound attenuators, as is well known.

As is well known, reactive attenuators are attenuators for low frequencies, whose operation is based on their geometric forms. A reactive attenuator is composed of one or several chambers or tubes, and such an attenuator causes reflection of the sound energy back towards the source of sound, or reflection of the sound energy back and forth between the chambers, whereby part of the sound energy does not pass through the attenuator.

The prior art reactive sound attenuator consisting of one or several chambers is called chamber resonator. The extent of attenuation in a chamber resonator is determined by the ratio of the cross sectional area of the chamber to the cross sectional area of the related duct, and the frequencies that are attenuated are determined by the length of the chamber. The attenuation of transmission give by Equation I (below) is true when the largest transverse dimension of the chamber is smaller than 0.8×wavelength (L. Baranek, *Noise and Vibration Control*, McGraw-Hill, 1971).

$$L_{TL} = 10 \log \{1 + \tfrac{1}{4}(M - 1/m)^2 \sin^2 k1\} \text{db} \quad \text{(I)}$$

wherein $L_{TL}$ = attenuation of transmission (dB)

$m = S_2/S_1$ (−)

$S_1$ = cross-sectional area of duct ($m^2$)

$S_2$ = cross-sectional area of chamber ($m^2$)

$k$ = wave number $(m+1) = 2\pi/\lambda$ $\lambda$ = wavelength (m)

$1$ = length of chamber (m)

From the above Equation I, it is seen that the attenuation of the chamber resonator is a periodic function of k1 and receives the value 0dB when the length of the chamber is $\lambda/2$, $\lambda$, $3\lambda/2$, etc. In a corresponding way, the maximum attenuation is obtained when the length 1 of the chamber is $\lambda/4$, $3\lambda/4$, $5\lambda/4$, etc.

As is well known, such a chamber resonator is called tube resonator in which a tube is installed in the partition wall that separates, for example, two chambers from one another. If the tube is installed so that its ends are placed in the middle of the chambers maximal attenuation is achieved, besides with the normal frequency of the maximum attenuation of a chamber resonator, also when the length 1 of the chamber is $\lambda/2$, $3\lambda/2$, $5\lambda/2$, etc., i.e. $L_{TL}$ = 0dB when $1 = \lambda$, $2\lambda$, $3\lambda$, etc.

As can be ascertained from the above, in the prior-art ordinary reactive sound attenuators, in which the partition wall between the chambers is perpendicular, i.e. at a right angle, to the flow direction, it is a problem that therein there is always a frequency of zero attenuation, i.e., a frequency at which the attenuator does not attenuate the noise at all. The frequency of zero attenuation occurs with the wavelengths as per the Equation II.

$$n \cdot \lambda/2 = 1_{chamber} \quad \text{(II)}$$

wherein $n = 1,2,3, \ldots$ (chamber resonator)

$n = 2,4,6, \ldots$ (tube resonator)

$\lambda$ = wavelength (m)

$1_{chamber}$ = chamber length (m)

OBJECTS AND SUMMARY OF THE INVENTION

In view of the above, it is an object of the present invention to provide a sound attenuation arrangement in which a complete zero attenuation in reactive attenuators is avoided.

In view of achieving the objective given above, those that will come out later, and others, in the sound attenuator in accordance with the invention, the main plane of the partition wall is at an acute angle in relation to the direction of flow of the air flowing through the sound attenuator.

In a reactive sound attenuator in accordance with the invention, zero attenuation occurs just in a differentially thin slice, whereby complete zero attenuation in the sound attenuator is avoided.

Further, by means of the attenuator in accordance with the invention, a wider and more uniform attenuation is achieved than by means of corresponding prior art resonators.

More particularly, according to the present invention, in an attenuator, the main plane of the partition wall that separates the chambers in a wide range reactive sound attenuator is placed at an acute angle, i.e. at a non-right (90°) angle in relation to the direction of flow of the air that flows through the sound attenuator. In this way, the frequency of zero attenuation in the sound attenuator is changed continuously in accordance with the length of the chamber and, thus, complete zero attenuation in the chamber is avoided.

BRIEF DESCRIPTION OF THE DRAWINGS

The following drawings are illustrative of embodiments of the invention and are not meant to limit the scope of the invention as encompassed by the claims.

DETAILED DESCRIPTION

Figure 1A:
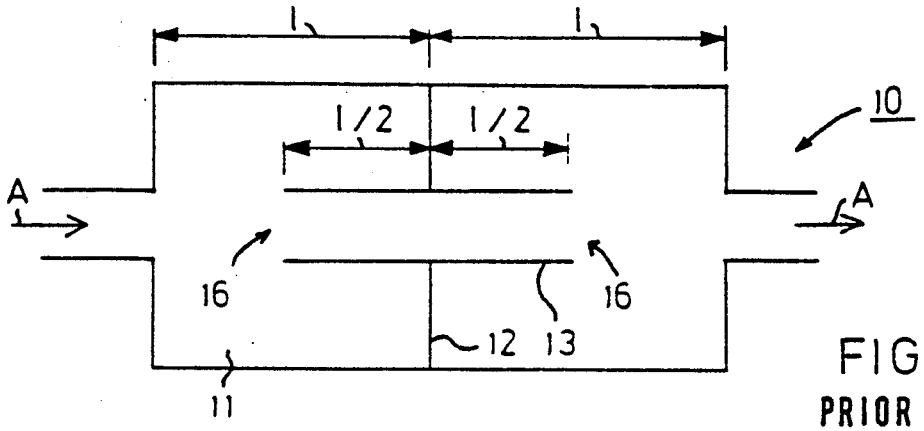
FIG.1A PRIOR ART
FIG. 1A is a schematic illustration of a prior art tube-resonator sound attenuator.

A prior art tube-resonator sound attenuator 10 as shown in FIG. 1A usually consists of two chambers 11 separated by a partition wall 12. Through the partition wall 12, a tube 13 has been installed, whose ends 16 have been dimensioned to be placed in the middle of the chambers 11 in order to obtain the best attenuation. The length of the chamber 11 is denoted with the reference 1, and the length of the tube 13 installed through the partition wall 12, at the side of each chamber, is denoted with the reference $\frac{1}{2}$. In the prior art tube resonator 10 as shown in FIG. 1A, the chambers 11 are equally large.

In such a tube resonator, zero attenuation occurs in accordance with the equation III.

$$k \times 1 = n \times 2\pi \qquad \text{(III)}$$

wherein k = wave number $= 2\pi/\lambda$(1/m)

1 = length of chamber.

$\lambda$ = wavelength (m).

n = 1,2,3, ...

Figure 1B:
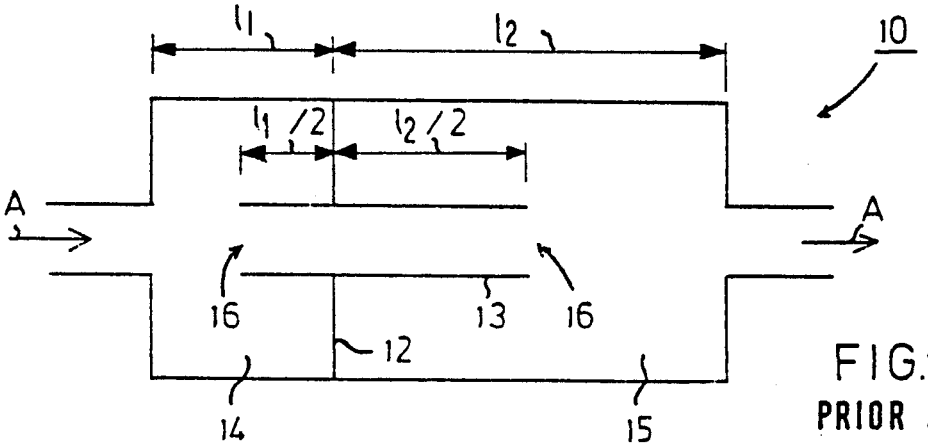
FIG.1B PRIOR ART
FIG. 1B is a schematic illustration of a second embodiment of a prior art tube resonator.

If the chambers 14 and 15 in the tube resonator 10 are constructed in the manner shown in FIG. 1B, and in the way known from the prior art, so that the chambers have different lengths $1_1$, $1_2$, at the frequency of zero attenuation of one chamber 14, 15, attenuation is produced in the other chamber 15, 14 at said frequency. In the tube-resonator sound attenuator 10, a tube 13 is installed through the partition wall 12, the ends 16 of said tube being placed in the middle of the respective chamber 14, 15, i.e. the length of the tube 13 portion placed at the side of the chamber 14 is $1_1/2$, and the length of the tube 13 portion placed at the side of the chamber 15 is $1_2/2$.

Figure 1C:
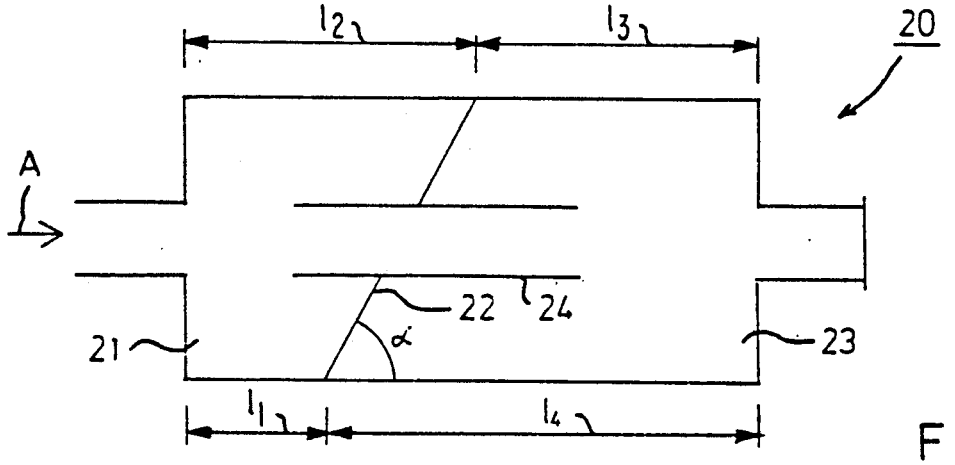
FIG. 1C is a schematic illustration of a tube resonator in 10 accordance with the invention.

As is shown in FIG. 1C, in the tube-resonator sound attenuator 20 in accordance with the invention the partition wall 22 that separates the chamber 21, 23 is installed at an acute angle $\alpha$ in relation to the flow direction A of the air that flows through the sound attenuator. In this way, the k1 number of each chamber 21, 23 can be made continuously varying within certain limits. In the partition wall 22 in the tube resonator 20, a tube 24 is installed, which is placed in the flow direction A of the air that flows through the sound attenuator. The lengths of the chambers 21, 23 are denoted with the references $1_1$, $1_2$ and $1_3$, $1_4$, respectively.

Figure 2A:
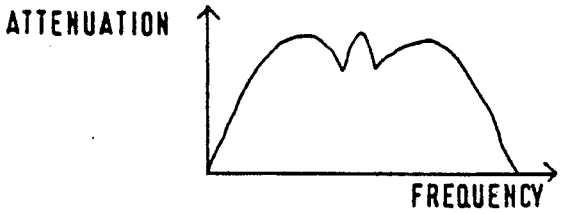
FIGS. 2A to 2C illustrate the attenuations of principle in the tube resonators shown in FIGS. 1A, 1B and 1C.
Figure 2B:
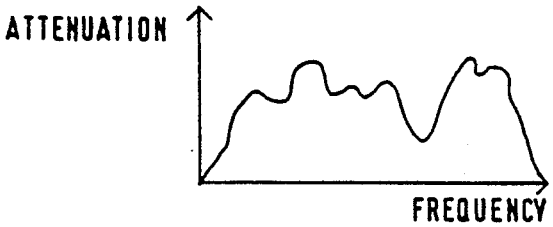
Figure 2C:
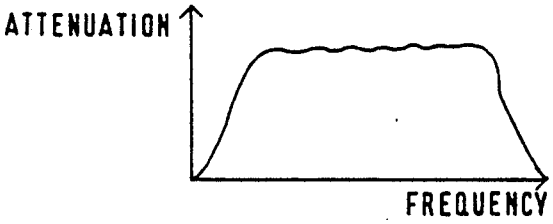

FIGS. 2A to 2C show the attenuations of principle of the tube resonators shown above in FIGS. 1A, 1B and 1C. FIG. 2A shows the attenuation in a prior-art tube-resonator attenuator as shown in FIG. 1A. The attenuation shown in FIG. 2B represents a prior art attenuator as shown in FIG. 1B, and FIG. 2C shows the attenuation in a tube-resonator sound attenuator of the invention as shown in FIG. 1C. As can be seen from FIG. 2C, by means of the sound attenuator of the present invention, a wider and more uniform attenuation is achieved than by means of corresponding prior art attenuators.

Figure 3:
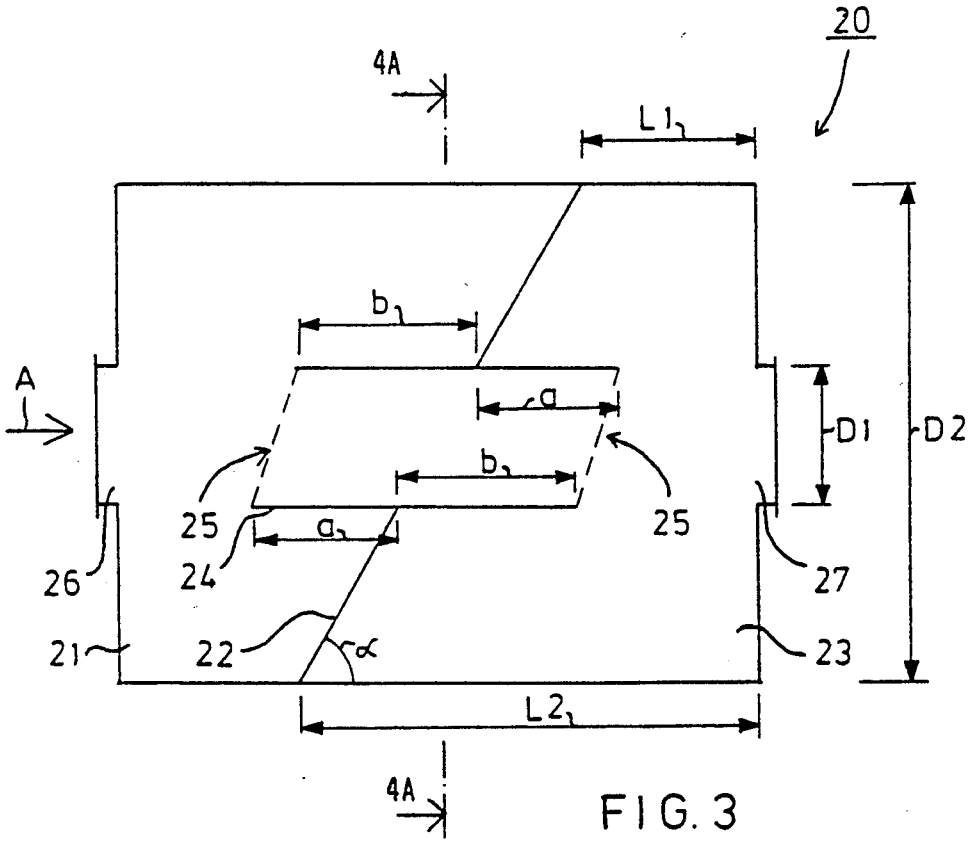
FIG. 3 is a schematic illustration of an exemplifying embodiment of a tube resonator in accordance with the invention.

FIG. 3 is a schematic illustration of a tube resonator sound attenuator 20 in accordance with the invention, which consists of two chamber 21, 23 separated from one another by a partition wall 22 placed at an acute angle $\alpha$ in relation to the flow direction A of the air that flows through the sound attenuator. A tube 24 has been installed through the partition wall 22, which tube is parallel to the flow direction A of the air that flows through the sound attenuator. The dimensioning of the tube 24 is calculated in accordance with the Equation IV and V, and the terms given in said equations refer to the dimensions contained in FIG. 3. The shorter length of the tube 24 placed at the side of each chamber 21, 23 is denoted with the reference a, and the longer length with the reference b. $L_1$ is the longer length extending from the end of the chamber to the partition wall 22. $D_1$ is the diameter of the duct system and, at the same time, of the end part 26, 27, and $D_2$ is the diameter of the chamber.

$$a = \frac{1}{2}\left\{ (D2 - D1)\left(\frac{L2 - L1}{2*D2}\right) + L1 \right\} \qquad \text{(IV)}$$

$$b = \frac{1}{2}\left\{ (D2 - D1)\left(\frac{L2 - L1}{2*D2}\right) + L1 \right\}. \qquad \text{(V)}$$

The tube-resonator sound attenuator 20 is connected to the system of air-conditioning ducts by means of the end parts 26 and 27. Thus, air flows out of the duct system through the end part 26 into the first chamber 21 and through the tube 24 out of the first chamber 21 into the second chamber 23 and further away through the end part 27. As can be seen from the figure, the planes parallel to the ends 25 of the central tube 24 are also placed at an acute angle in relation to the flow direction A in a way similar to the main plane of the partition wall 22. The angle $\alpha$ formed by the main plane of the partition wall 22 in relation to the flow direction A of the air that flows through the sound attenuator is preferably from about 40° to about 70°. If necessary, the angle $\alpha$ can be adjusted in accordance with the range of attenuation.

Figure 4A:
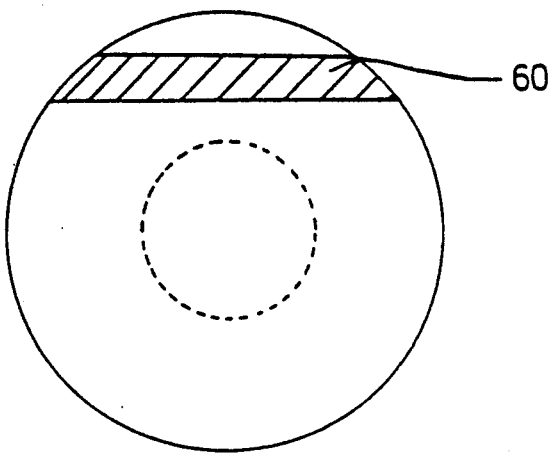
FIGS. 4A to 4C are schematic illustrations of examples of cross sections 4A—4B (FIG. 3) of a sound attenuator in accordance with the invention in the direction perpendicular to the flow direction of the air flowing through the sound attenuator.
Figure 4B:
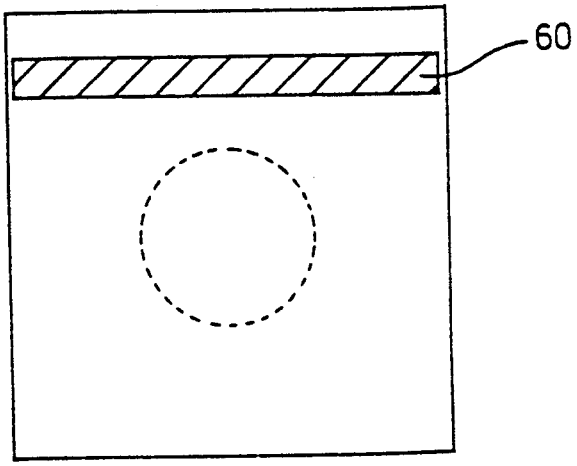
Figure 4C:
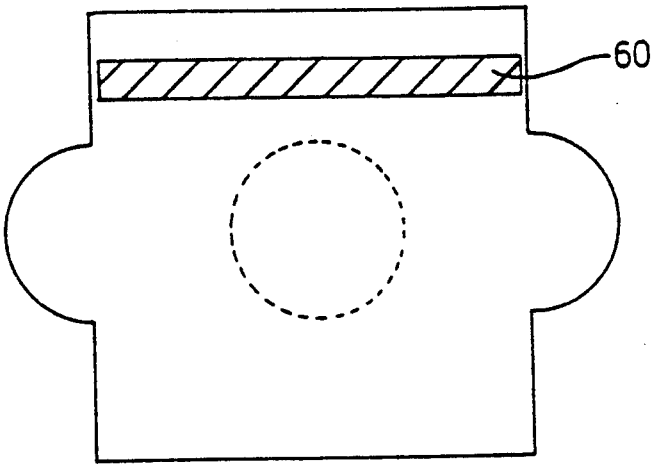

FIGS. 4A to 4C are schematic illustrations of alternative cross sections of a tube resonator or chamber-resonator sound attenuator in accordance with the invention in the direction perpendicular to the flow direction A of the air that flows through the sound attenuator at the point 4A—4A indicated schematically in FIG. 3.

The cross section as shown in FIG. 4A is circular, and in such a sound attenuator the attenuation face is variable, as comes out for the slice 60 of attenuation face. The slice 60 of attenuation face represents an extremely thin attenuation face. The cross section B—B shown in FIG. 4B is rectangular, and with such a cross section, a partly invariable attenuation face is obtained. The slice of attenuation face is denoted with the reference numeral 60. Likewise, in the cross section B—B shown in FIG. 4C, the slice of attenuation face is denoted with the reference numeral 60. The cross section is rectangular in shape and comprises semi-circles penetrating to the slides. In such a case, an invariable attenuation face is obtained. With the cross sections as shown in FIGS. 4B and 4C, an attenuation better than that with a cross section as shown in FIG. 4A is obtained at the extreme ends of the frequency range that is attenuated. The most advantageous cross-sectional shape is that shown in FIG. 4B, because a cross section as shown in FIG. 4C is manufacturing-technically difficult.

Figure 5A:
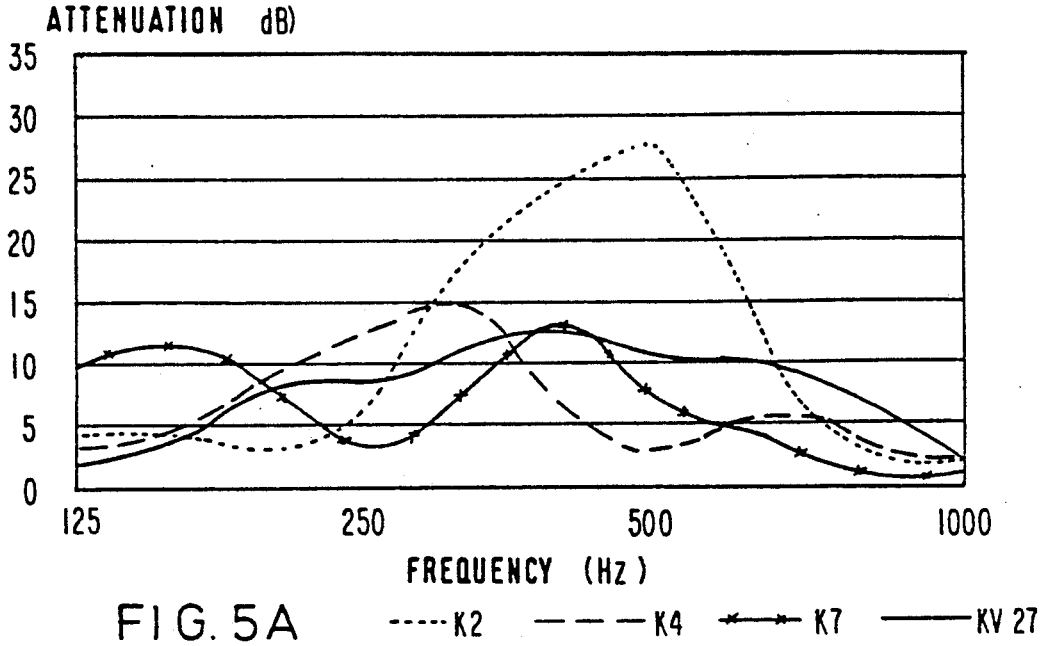
FIGS. 5A to 5E show the results of a measurement of attenuation of a chamber resonator sound attenuator in accordance with the invention as compared with the results of measurements of attenuation of prior art chamber-resonator attenuators.
Figure 5B:
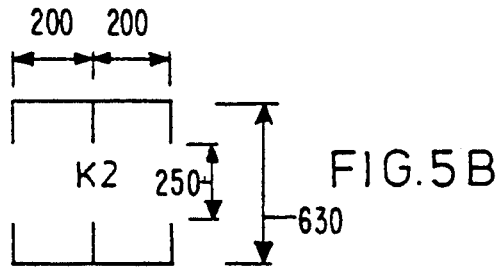
Figure 5C:
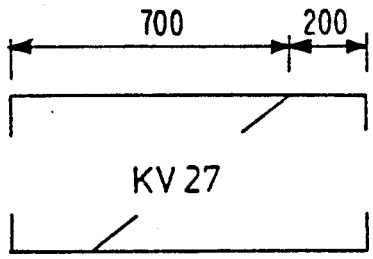
Figure 5D:
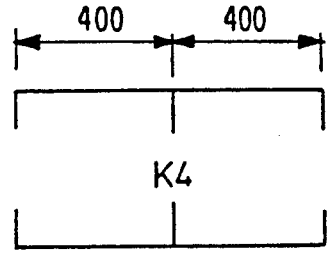
Figure 5E:
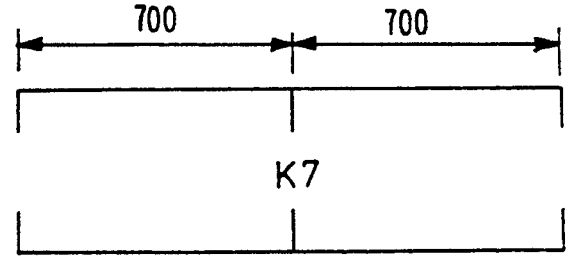

FIGS. 5A to 5C show examples of results of attenuation measurements when a chamber-resonator sound attenuator KV27 in accordance with the invention as shown in FIG. 5C is compared with prior art chamber resonators K2, K4, K7 as shown in FIGS. 5B to 5E. As can be seen from the measurement results given in FIG. 5A, by means of the chamber-resonator sound attenuator in accordance with the invention, a wide and uniform attenuation of sound is achieved. In the schematic illustration of chamber-resonator sound attenuators in FIGS. 5B to 5E, examples of dimensioning are given in respect of said measurement, whose results are, thus, given in FIG. 5A. In FIG. 5A, the vertical axis represents the attenuation in decibels, and the horizontal axis represents the frequency as cycles per second (Hz).

Figure 6A:
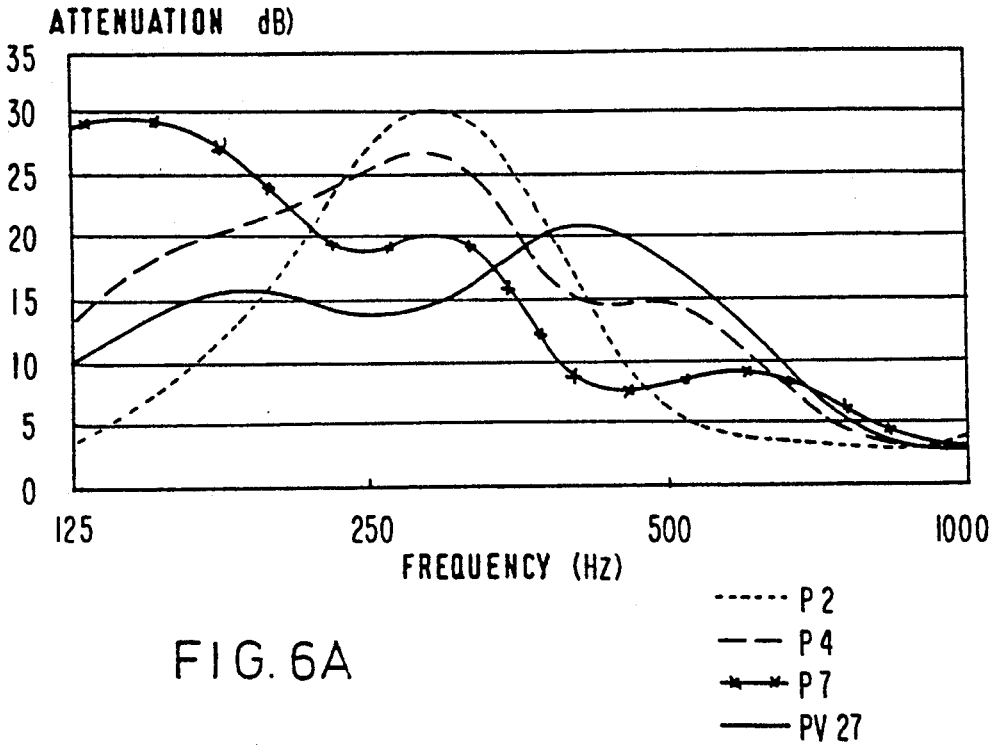
FIG. 6A to 6E show the results of a measurement of attenuation of a tube-resonator sound attenuator in accordance with the invention as compared with the results of measurements of attenuation of prior art tube resonator sound attenuators.
Figure 6B:
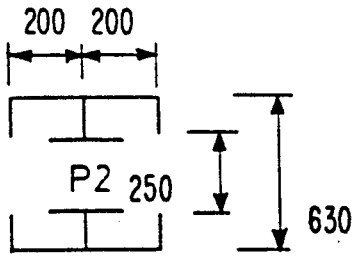
Figure 6C:
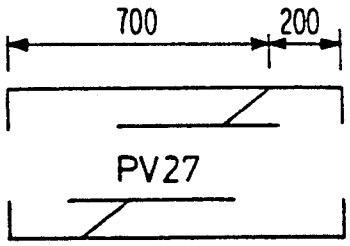
Figure 6D:
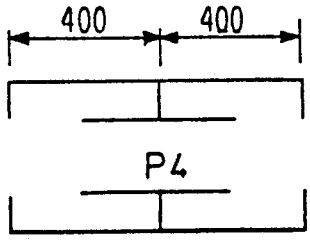
Figure 6E:
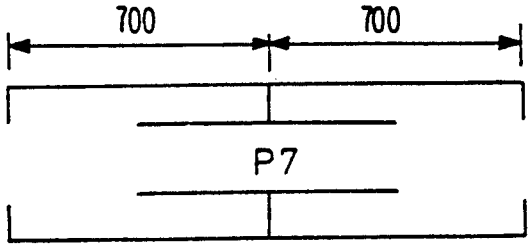

FIGS. 6A to 6E show the results of attenuation measurements with a tube-resonance sound attenuator PV27 as compared with results of sound attenuation with prior art tube resonator sound attenuator P2, P4, P7. FIGS. 6B to 6E show the dimensioning of the tube resonators used in the measurement, and FIG. 6A gives the measurement results. The vertical axis represents the attenuation in decibels, and the horizontal axis the frequency as cycles per second.

Figure 7:
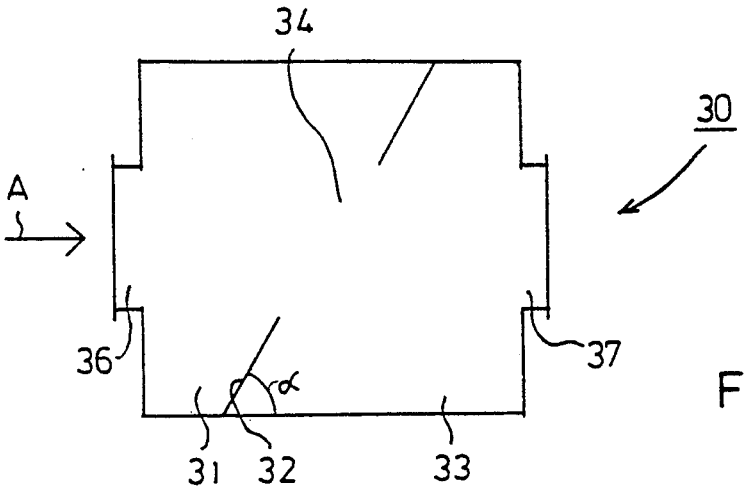
FIG. 7 is a schematic illustration of a chamber resonator in accordance with the invention.

FIG. 7 is a schematic illustration of a chamber-resonator sound attenuator 30 in accordance with the invention. The chamber resonator 30 consists of two chambers 31 and 33, which are separated from one another by a partition wall 32 provided with an opening 34. The main plane of the partition wall 32 is placed at an acute angle $\alpha$ in relation to the flow direction A of the air that flows through the sound attenuator. The angle $\alpha$ is about 40° to about 70°. The chamber resonator 30 is connected to the system of air-conditioning ducts by means of the end parts 36 and 37. The air flows through the end part 36 into the first chamber 31 of the sound attenuator and further through the opening 34 into the second chamber 33 and finally through the end part 37 out of the sound attenuator. In respect of its principles of attenuation, the exemplifying embodiment of a sound attenuator in accordance with the invention shown in FIG. 7 corresponds to the exemplifying embodiments shown in FIGS. 1C, 3 and 4A to 4C.

Figure 8:
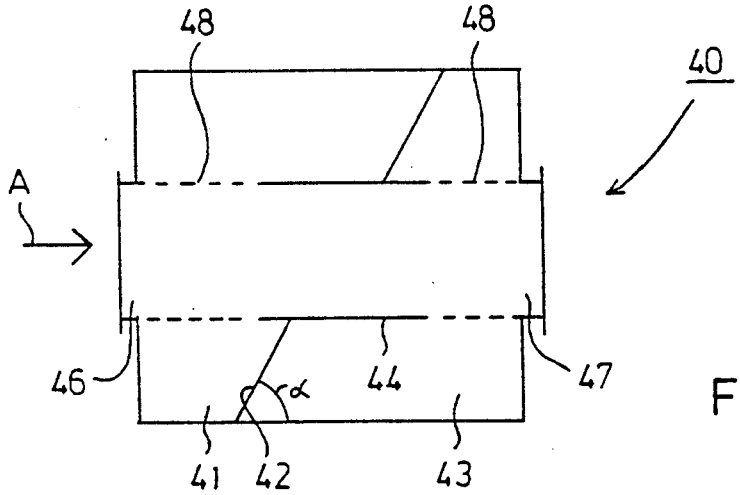
FIG. 8 is a schematic illustration of a further exemplifying embodiment of a sound attenuator in accordance with the invention.
Figure 10:
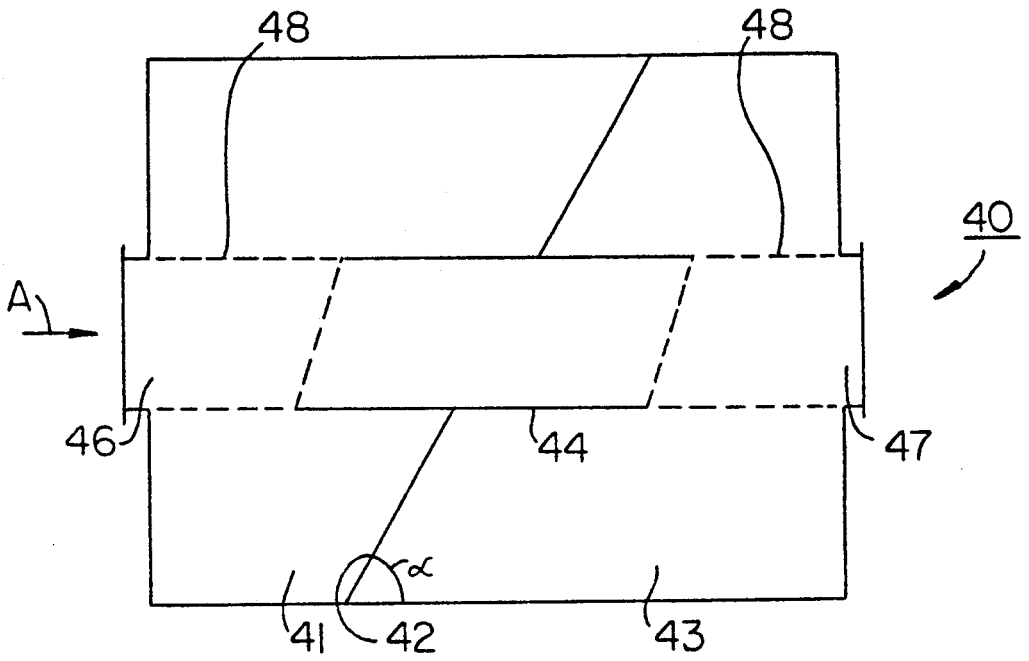
FIG. 10 is another exemplifying embodiment of a sound attenuation in accordance with the invention.

FIGS. 8 and 10 show a tube-resonator sound attenuator 40 in principle corresponding to the tube resonator in accordance with the invention shown in FIGS. 1 and 3 and, respectively, thus, consisting of two chambers 41, 43 and of a partition wall 42 separating them, the main plane of said wall being at an acute angle $\alpha$ in relation to the flow direction A of the air that flows through the second attenuator. A central tube 44 is installed in the partition wall 42.

In these exemplifying embodiments, to reduce the pressure loss, a perforated tube 48 has been installed between the central tube 44 and the ends 46 and 47 of the chamber. The diameter of 10 the holes may be, e.g. 4 mm, and the proportion of the holes may be 30% of the total area.

Figure 9:
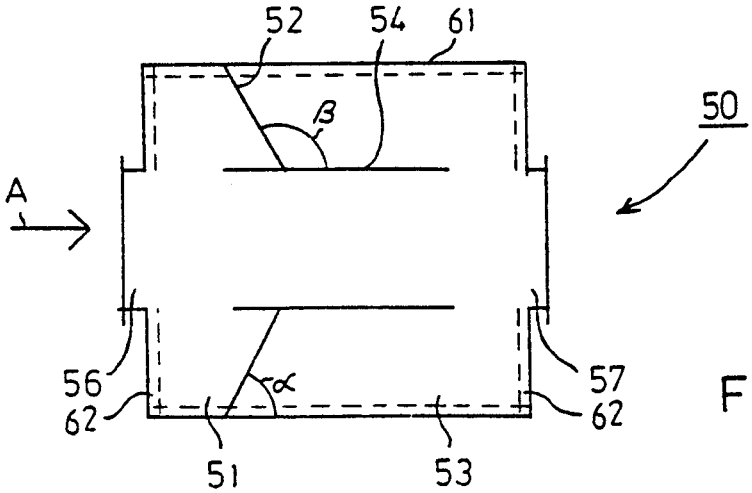
FIG. 9 is a schematic illustration of a second further exemplifying embodiment of a sound attenuator in accordance with the invention.

FIG. 9 is a schematic illustration of an exemplifying embodiment of a second attenuator in accordance with the invention in which the partition wall 52 that separates the chamber 51 and 53 in the tube resonator 50 has been installed in conical shape in connection with the central tube 54. The partition wall 52 is placed at the angles $\alpha$, $\beta$ in relation to the flow direction A of the air that flows through the sound attenuator. The angle $\beta = 180° - \alpha$. The sound attenuator 50 is connected to the system of air-conditioning ducts by means of the end parts 56 and 57.

The chambers 51, 53 of a sound attenuator as shown in FIG. 9 may be lined with a material that absorbs sound. Either the walls of the chamber 51, 53 are provided with a lining 61 that absorbs sound, or the ends are provided with a lining 62 that absorbs sound, or both are provided with a lining 61, 62 that absorbs sound. The other sound attenuators in accordance with the invention described above may also be provided with a material that absorbs sound and is fitted on the chamber walls and/or ends.

As different versions of the reactive sound attenuator in accordance with the invention, it is possible to manufacture resonators in which the partition wall is conical or spiral-shaped. Also, the planes parallel to the ends of the central tube in a tube resonator may be at an acute angle in relation to the flow direction of the air that flows through the sound attenuator. It is also possible to combine partition walls and ends of different types. Different cross-sectional forms are also possible in addition to those shown in FIGS. 4A to 4C, for example, the shape of a polygon.

In a preferred embodiment of the invention, the partition wall is placed at an acute angle in relation to the flow direction of the air that flows through the sound attenuator, and the ends of the central tube are, in a corresponding way, at an acute angle in relation to the flow direction of the air that flows through the sound attenuator, and the cross-sectional shape of the chamber is rectangular in the direction perpendicular to the flow direction of the air that flows through the sound attenuator.

The examples provided above are not meant to be exclusive. Many other variations of the present invention would be obvious to those skilled in the art, and are contemplated to be within the scope of the appended claims.

What is claimed is:

1. The reactive sound attenuator for air-conditioning ducts, in particular for air ducts in paper mills, comprising a partition wall separating said sound attenuator into first and second inner chambers, said first and second chambers each having an end opposite said partition wall, each of said ends and said partition wall provided with an opening, said sound attenuator arranged such that air flows through said end of said first chamber through said opening in said partition wall and through said end of said second chamber, said partition wall having a main plane arranged at an acute angle in relation to a direction of air flow through said sound attenuator, a central tube arranged in said opening of said partition wall,. a length of said central tube being arranged parallel to the direction of air flow through said sound attenuator, said central tube having a first end extending into said first chamber and a second end extending into said second chamber, said first and second ends of said central tube being structured such that planes parallel to said first and second ends of said central tube are arranged at an acute angle in relation to the direction of air flow through said sound attenuator, and perforated tubes connected between said first and second ends of said central tube and said ends of said first and second chambers, respectively.

2. The sound attenuator of claim 1, wherein said partition wall is arranged at an angle from about 40° to about 70° in relation to the direction of air flow through said sound attenuator.

3. The sound attenuator of claim 1, wherein said sound attenuator has a circular cross-sectional shape in a direction perpendicular to the direction of air flow through said sound attenuator.

4. The sound attenuator of claim 1, wherein said sound attenuator has a rectangular cross-sectional shape in a direction perpendicular to the direction of air flow through said sound attenuator.

5. The sound attenuator of claim 1, wherein said sound attenuator has a rectangular cross-sectional shape in a direction perpendicular to he direction of air flow through the sound attenuator, said sound attenuator including side walls having projections therein of a semi-circular shape.

6. The sound attenuator of claim 1, which is structured and arranged to fit in an air-conditioning duct.

7. The sound attenuator of claim 1, wherein said chambers are lined with a material that absorbs sound.

8. The sound attenuator of claim 7, wherein said ends of said first and second chambers are lined with a material that absorbs sound.

9. The sound attenuator of claim 1, wherein one of said first or second chamber has a length along the direction of air flow which is longer than said other chamber.

10. A reactive sound attenuator for air-conditioning ducts, in particular for air ducts in paper mills, comprising a partition wall separating said sound attenuator into first and second inner chambers, said first and second chambers each having an end opposite said partition wall, each of said ends and said partition wall provided with an opening, said sound attenuator arranged such that air flows through said end of said first chamber through said opening in said partition wall and through said end of said second chamber.

said partition wall having a main plane arranged at an acute angle in relation to a direction of air flow through said sound attenuator, a central tube arranged in said opening of said partition wall, a length of said central tube being arranged parallel to the direction of air flow through said sound attenuator, and said sound attenuator having a rectangular cross-sectional shape in a direction perpendicular to the direction of air flow through the sound attenuator, said sound attenuator including side walls having projections therein of a semi-circular shape.

11. The sound attenuator of claim 10, wherein said partition wall is arranged at an angle from about 40° and 70° in relation to the direction of air flow through said sound attenuator.

12. The sound attenuator of claim 10, which is structured and arranged to fit in an air-conditioning duct.

13. The sound attenuator of claim 10, wherein said chambers are lined with a material that absorbs sound.

14. The sound attenuator of claim 10, wherein one of said first or second chamber has a length along the direction of air flow which is longer than said other chamber.

15. The sound attenuator of claim 10, wherein said central tube has a first end extending into said first chamber and a second end extending into said second chamber, said first and second ends of said central tube being structured such that planes parallel to said first and second ends of said central tube are arranged at an acute angle in relation to the direction of air flow through said sound attenuator.

16. The sound attenuator of claim 15, further comprising perforated tubes connected between said first and second ends of said central tube and said ends of said first and second chambers, respectively.

* * * * *